US009328521B2

(12) United States Patent
Huss

(10) Patent No.: US 9,328,521 B2
(45) Date of Patent: May 3, 2016

(54) MODULAR MOLDED MAT WITH EXPOSABLE RAMP SURFACES

(71) Applicant: Philip C. Huss, Rockvale, TN (US)

(72) Inventor: Philip C. Huss, Rockvale, TN (US)

(73) Assignee: WEARWELL, Smyrna, TN (US)

( * ) Notice: Subject to any disclaimer, the term of this patent is extended or adjusted under 35 U.S.C. 154(b) by 0 days.

(21) Appl. No.: 14/317,569

(22) Filed: Jun. 27, 2014

(65) Prior Publication Data

US 2015/0376904 A1 Dec. 31, 2015

(51) Int. Cl.

| | |
|---|---|
| ***E04F 15/22*** | (2006.01) |
| ***E04B 5/00*** | (2006.01) |
| ***E04F 15/02*** | (2006.01) |

(52) U.S. Cl.

CPC ..... *E04F 15/225* (2013.01); *E04B 5/00* (2013.01); *E04F 15/02038* (2013.01); *E04F 15/02172* (2013.01); *E04F 15/02177* (2013.01)

(58) Field of Classification Search

CPC ..... E04F 15/225; E04F 15/02172; E04F 15/02038; E04F 15/02177; E04B 5/00

USPC ..... 52/177, 589.1, 384, 385, 716.1, 98

See application file for complete search history.

(56) References Cited

U.S. PATENT DOCUMENTS

| | | | | |
|---|---|---|---|---|
| 4,226,064 | A * | 10/1980 | Kraayenhof | 52/180 |
| 4,387,128 | A | 6/1983 | Emms et al. | |
| 4,436,779 | A | 3/1984 | Menconi et al. | |
| 4,468,910 | A * | 9/1984 | Morrison | 52/591.2 |
| 5,190,799 | A * | 3/1993 | Ellingson, III | 428/53 |
| 5,341,533 | A * | 8/1994 | Seitz | 14/69.5 |
| 5,527,128 | A * | 6/1996 | Rope et al. | 404/35 |
| 5,630,304 | A * | 5/1997 | Austin | 52/384 |
| 5,833,386 | A * | 11/1998 | Rosan et al. | 404/36 |
| 6,467,224 | B1 * | 10/2002 | Bertolini | 52/177 |
| 6,802,159 | B1 * | 10/2004 | Kotler | 52/177 |
| 6,966,155 | B2 | 11/2005 | Nevison | |
| 7,114,298 | B2 * | 10/2006 | Kotler | 52/177 |
| 7,636,960 | B2 | 12/2009 | Hawley et al. | |
| 7,640,706 | B2 * | 1/2010 | Stanchfield | 52/464 |
| 7,757,449 | B2 * | 7/2010 | Ibanez et al. | 52/384 |
| 7,946,083 | B2 * | 5/2011 | Kirby | 52/177 |
| 8,006,443 | B2 | 8/2011 | Fuccella et al. | |
| 8,109,059 | B2 * | 2/2012 | Proot | 52/468 |
| 8,225,566 | B2 * | 7/2012 | Prevost et al. | 52/302.1 |
| D692,595 | S | 10/2013 | Calkins | |
| 2002/0119275 | A1 | 8/2002 | Williamson | |
| 2003/0061772 | A1 * | 4/2003 | Bertolini | 52/98 |
| 2004/0088928 | A1 * | 5/2004 | Headrick et al. | 52/98 |
| 2005/0252109 | A1 * | 11/2005 | Fuccella | E04F 15/02172 52/177 |

(Continued)

FOREIGN PATENT DOCUMENTS

| | | |
|---|---|---|
| EP | 0 955 005 | 11/1999 |

*Primary Examiner* — Brent W Herring
(74) *Attorney, Agent, or Firm* — Clark & Brody

(57) ABSTRACT

The present invention is generally directed to an interlocking modular mat or tile and method of use. The mat comprises a severable core structure with a ramp around its periphery and a connected outer structure. The outer structure surrounding the inner core structure is partitioned into side and corner panels also having ramps internally disposed therein. The novel features of the mat allows it to be cut along several locations to expose the internal ramp structure within each panel, providing a assembled mat system with a secure border around the entire mat. A method of constructing an array of the novel mat panel members involving cutting to expose the internal ramped structure is also disclosed to provide a flooring surface.

19 Claims, 7 Drawing Sheets

(56) References Cited

U.S. PATENT DOCUMENTS

| | | | | |
|---|---|---|---|---|
| 2005/0277490 | A1* | 12/2005 | Allen | 473/415 |
| 2006/0272252 | A1 | 12/2006 | Moller | |
| 2007/0283654 | A1* | 12/2007 | Stanchfield et al. | 52/465 |
| 2008/0034700 | A1* | 2/2008 | Stanchfield et al. | 52/582.1 |
| 2008/0216437 | A1* | 9/2008 | Prevost et al. | 52/589.1 |
| 2012/0111238 | A1 | 5/2012 | Frankenberg | |
| 2013/0167458 | A1 | 7/2013 | Cerny et al. | |
| 2013/0291457 | A1 | 11/2013 | Tillery et al. | |
| 2015/0027079 | A1* | 1/2015 | Pantev | F16B 5/0084 52/582.2 |

* cited by examiner

MODULAR MOLDED MAT WITH EXPOSABLE RAMP SURFACES

FIELD OF THE INVENTION

The present invention is generally directed to an interlocking modular mat or tile and method of use in the field of flooring surfaces. The novel features of the mat or tile panels allow them to be cut along several locations to expose the internal ramp structure within each panel, providing the assembled mat system with ramps along the borders of the assembled mat. A method of interconnecting an arrangement of mat or tiles and exposing the ramped portions to provide a flooring surface or covering is also disclosed.

BACKGROUND ART

Modular floor mats or tiles are often used as components on the construction of a flooring system. A mat or tile system may be designed as a floor covering for an entire room, or a floor covering for a section of a room. Typically, the mat or tile system components may be manufactured from, for example, semi-rigid, plasticized, virgin polyvinyl chloride, virgin/reclaimed polyvinyl chloride mixtures and also materials such as recycled rubber, or from compression molded thermoplastic materials such as, thermoplastic polyurethane (TPU), or thermoplastic rubber, for example. Other materials include thermoplastic co-polyesters or thermoplastic polyamides, elastomeric alloys, polyolefin blends (TPE-o) and the like.

The mat or tile system, when used as a floor or ground covering, is suitable to withstand inclement weather, harsh environments, heavy traffic, and resist damage when exposed to harsh chemicals. Primary uses for the modular floor tiles of the present invention include providing lateral support, and providing comfort and reduction of fatigue during walking or standing. In the prior art, the use of molded mats, e.g., polyurethane foam molded mats, in industrial and commercial applications is well known. These foam mats are advantageous because of the resiliency and cushioned support that the foam provides for workers when the workers are engaging in tasks that require an excessive amount of standing in a given location.

Various types of modular floor tiles have increased in popularity due to their versatility. A free-standing modular floor mat system typically provides a non-slip modular system that optionally is self-draining and has multiple configuration capabilities.

The mat system is typically assembled from mat elements or units, herein referred to as mat or tiles. Typically, each mat or tile comprises interlocking members which connect adjacent panel members. Male and female portions are typically employed in the form of hole and peg structures, such as set forth in U.S. Pat. No. 8,006,443, or in jigsaw or tooth type structures as exemplified in U.S. Pat. No. 4,287,693. Conventionally, mats or tiles are assembled into a structure covering a floor or surface with a shape adapted to the intended shape of the mat or tile system. For example, the assembled mat or tile system can be simply a closed rectangular shape or a rectangular shape with inner open areas, or any overall shape that can be constructed with mat panel or tile member structures.

Further, a ramped mat component is typically attached to the periphery of the mat system, during or after assembly of the internal mat or tile components. The manner of attachment of the ramp portion is generally similar to the manner of male-female manner of attachment of the internal mat panel or tile elements, noted above. The ramp portion serves to allow a smooth transition between the upper surface of the mat or tile system and the existing flooring surface. Aside from aesthetics, the ramped portions provide a measure of safety against tripping by the user. For example, Pre Grant Publication 2009/0205269, Pre Grant Publication 2013/0291457, and U.S. Pat. No. 6,966,155, are illustrative of mat systems with attachable ramp components. These types of mat systems conventionally require separate ramp pieces and/or connectors to be purchased or modified to provide inside and outside corners when interlocked with the mat edges. For example, modifications by trimming ramp pieces to provide inside and outside corners, inherently weakens the integrity of the abutting ramp portions.

Further, another demand in the workplace is that floor mats need to be easily configured and reconfigured. Such prior art systems are not readily modified as they often require new ramp pieces or connectors, which may not be readily available. Further, mat systems using separate connectors have not worked well in practice because they get lost or make alignment between adjacent mats difficult during reinstallation.

In any of these mat systems, the ramped portion is affixed to a side of a mat, is and therefore not held in place as well as other internal mat members, which reinforce one another. Instead, the prior art ramp portions, being small and light relative to the mat, rely substantially upon frictional engagement between the ramp portion and a portion of the perimeter of the mat body to hold the ramp portion in place. Therefore, these designs are susceptible to being dislodged accidently by improper force moments by machinery or other devices typically used on these mats.

In light of the drawbacks noted above in prior art mat designs, a need exists to provide improved mat construction, particularly, in the area of how the mats are constructed or reused to form even greater mat areas. The present invention responds to this need with an improved mat or tile panel, as well as a method of assembling and tailoring the inventive mats or tiles into a mat system facilitating to the provision of a secure ramped border around entire mat system assembly.

SUMMARY OF THE INVENTION

Accordingly, it is one object of the invention to provide an improved interlocking mat panel or tile element design which minimizes the number of unique mat panel or tile units that are required for assembly into the desired mat system or configuration with a ramped border.

Along these lines, it is another object of the invention to provide an improved interlocking mat panel or tile element design requiring only a single repeating mat panel or tile unit for assembly into the desired mat system or configuration having a ramped border.

Yet another object of the invention is a method of assembling and tailoring the assembled mat or tile system with the desired ramped border using a single cutting operation after assembly of the mat system, or tailored while the mats are assembled to expose the ramp borders.

Still another object of the invention is a method of modifying an existing mat system by removal and relocation of mat panel or tile elements and then cutting of mat panels along provided cut lines to expose new ramped portions within the mat panel to provide new borders around the mat system.

Other objects and advantages will become apparent as a description of the invention proceeds.

In satisfaction of the foregoing objects and advantages, the invention, in one mode, comprises a molded mat or tile panel which overall, is generally planar, has a top and bottom and sides.

In this application, the word "tile" is synonymously used with the term "mat", which, in turn, are also referred to as mat or tile "panels", "members", "units" or "structures". The terms "mat system" or "tile system", "mat assembly", and "tile assembly" are meant to define an assembly of mats or tiles to provide a covering for the floor or ground.

The mat of the present invention is fabricated with an inner core structure, designed to support traffic and, optionally, allow ventilation and drainage of liquids through the mat system. The internal core structure, for example, includes projection elements extending between said upper and lower portions of the internal core structure. The projection elements are exemplified by knoblike, peg like, conical, truncated conical members which distribute traffic loadings from the upper to the lower core portions, along the surface of the inner core structure. Further, ventilation and drainage is accommodated, for example, by a series of apertures or openings provided in the upper portion of the inner core structure, which is subjected to foot traffic.

Importantly, the inner core structure is provided with a tapered ramp structure formed around its sides, preferably during the molding process. This tapered ramp structure is further integrally connected to the outer panel structure by an attachment structure, which effectively bridges the inner core structure, having ramped sides, with the outer panel structure. The attachment structure effectively bridges the inner core structure with the outer panel structure and is formed by a channel, trough or groove molded into the upper and lower portions of the mat, adjacent to the ramped edge of the mat core structure.

Also possible is that the attachment structure can be discontinuous along the channels. For example, a series of tab members or segments, which are positioned around the internal core structure, can be used to secure the internal core structure to the outer panel structure.

Again, the attachment structure is preferably molded concomitantly with the internal core structure and outer panel structure, during the molding or formation of the mat. Therefore, the attachment structure is integral with the panel and to both inner core structure and outer panel structures, providing a secure coupling between the internal core and outer panel structures.

Further, the attachment structure of the present invention is designed to be readily severable, preferably by cutting operations, from the inner core structure and outer panel structures to allow exposure of the ramped profile along the periphery of the inner core structure, either before or after assembly of the mat system. To facilitate the severability of the mat, the mat can include one or more channels, troughs, or grooves, hereinafter channels. The channel can exist in the top or the bottom of the mat or both. The channel can be formed in the mat during its manufacture or exist as a result of the manner in which the side and corner panels are attached to the inner core structure. That is, a channel would exist where an end of a ramped surface of the inner core structure meets with a side panel. Similarly, such a channel would exist where the end of a ramped surface of a side panel meets with an underside of a corner panel. When employing a channel in the top of the mat, two ramped surfaces could exist for the inner core structure or side panel. The channel provides a guide along which a cutting implement or tool, e.g., a knife or the like, could be used to sever the side and/or corner panel of the mat to form a ramp-containing peripheral side. The shape of the channel formed by the junction of the end of the ramped surface and the underside of a side or corner panel is a function of the configuration of the underside of the side or corner panel. When this underside is raised from an overall bottom surface of the mat, the channel would be more v-shaped. If the underside of the corner or side panel would be aligned with the overall bottom of the mat, the channel would be more like a slit. Thus, the shape of the channel when existing in an underside of the mat can vary depending on the configuration of the underside of the side and/or corner panels.

In a further preferred embodiment, the channel, whether on the top and/or bottom can extend in a generally straight lines from each of the peripheral edges of the inner core structure to the outer perimeter of the outer panel structure. This effectively partitions the outer panel structure into side panels which oppose each side of the internal core structure and corner panels which abut adjacent side panels. In the preferred embodiment of a square or rectangular mat panel, there would be four side panels in parallel with each side of the inner core structure and four corner panels which abut adjacent side panels.

Additionally, the ramped profile of the peripheral sides of the inner core continues their shape, extending in straight lines through adjacent side panels towards the periphery of the edge of the mat. In this preferred embodiment, the entire panel can be completely cut along any of cutting channels to sever the attachment means bridging the inner core structure and side panel and/or between the side and corner panels. This novel design of the inventive mat panels allows for the inner core structure, side or corner panels to be simply cut out of the mat assembly to form the desired ramp portions around the border of the mat system, during or after installation of the mat system.

Since the attachment structure is integral and therefore formulated with the same materials as both the internal core and outer panel structures, it is important that the materials used to form the mat panels, preferably by molding operations, be soft enough to allow removal of the panels by cutting operations to expose the ramped border. To this effect, it is preferred to employ PVC, rubber, TPE or the like, which are resilient yet provides a resilient cushioned mat which can be trimmed by cutting with a blade, knife, or cutting tool. Other thermoplastic or thermosetting polymers can be used in the present invention to the extent they are suitable for a mat and with the proviso they can be easily cut by a blade or knife or other cutting tool. The detailed description provides additional details as to the softness of the preferred mat material to facilitate cutting operations.

Another aspect of the present invention is the requirement that unique panel members, described above, interlock with each other in order to be assembled into a mat system with ramped borders.

Any number of interlocking techniques can be applied to the instant invention. However, for the sake of illustration, the various drawings depict a series of outwardly projecting female couplings which interconnect with complementary male couplings, located on the underside of the mat. Male and female interlocking couplings serve to connect adjacent mats to form a mat system.

A further embodiment locates female connectors on two adjacent sides of the mat, with symmetrically opposed male connectors located on the remaining adjacent sides.

However, it is important to recognize that the novelty of this invention does not rely on a particular mat interlocking scheme. For example, while preferred, the female connector locations do not have to reside on two adjacent sides of the mat. For example, the female connector locations can alternate with the male connector locations in any desired pattern. Any conventional manner of interlocking can be also applied to join adjacent mats to the extent it cooperates with the novel ramp exposure design provided by the mat of the present invention.

Another aspect of the invention is a method of constructing the mat using the novel mats of the present invention.

DETAILED DESCRIPTION OF THE PREFERRED EMBODIMENTS

Figure 1A:
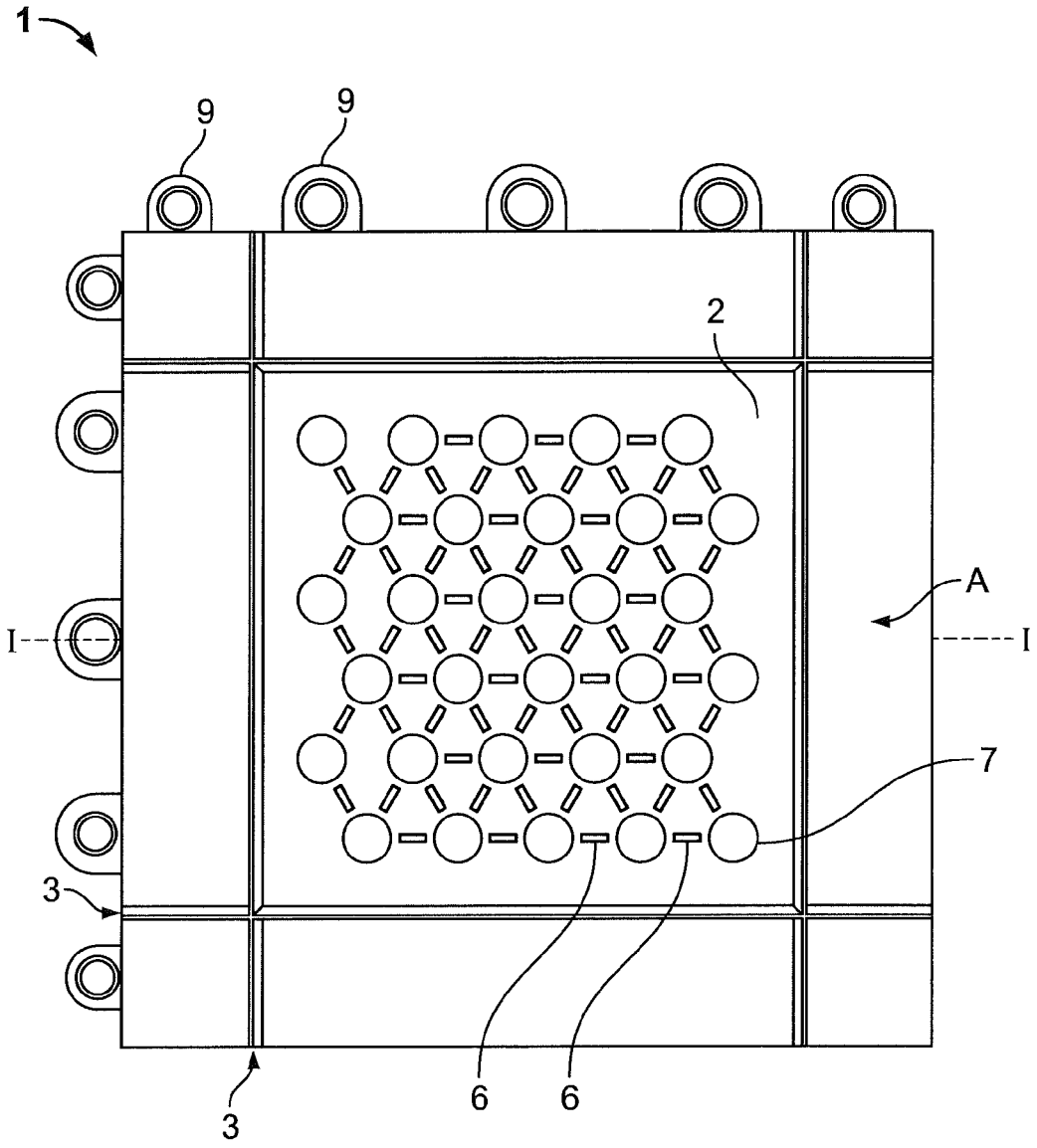
FIG. 1A illustrates a top surface of an upper portion of a mat or tile according to the present invention

For the purposes of this disclosure, the word "tile" is used synonymously with the term "mat". The terms, "mat" or "tile", for the purposes of this disclosure, also are also referred to as "mat" or "tile", "panels", "members", "units" or "structures". The terms "mat system" or "tile system", "mat assembly", "tile assembly" are meant to define an assembly of mats or tiles to provide a covering over a floor or ground FIG. 1A illustrates a top surface of an upper portion of mat 1 according to the present invention. Mat 1 is substantially planar and is designed to support traffic, provide a traction surface on the upper portion exposed to foot traffic and allow ventilation and drainage of liquids through the assembled mat system.

Figure 1B:
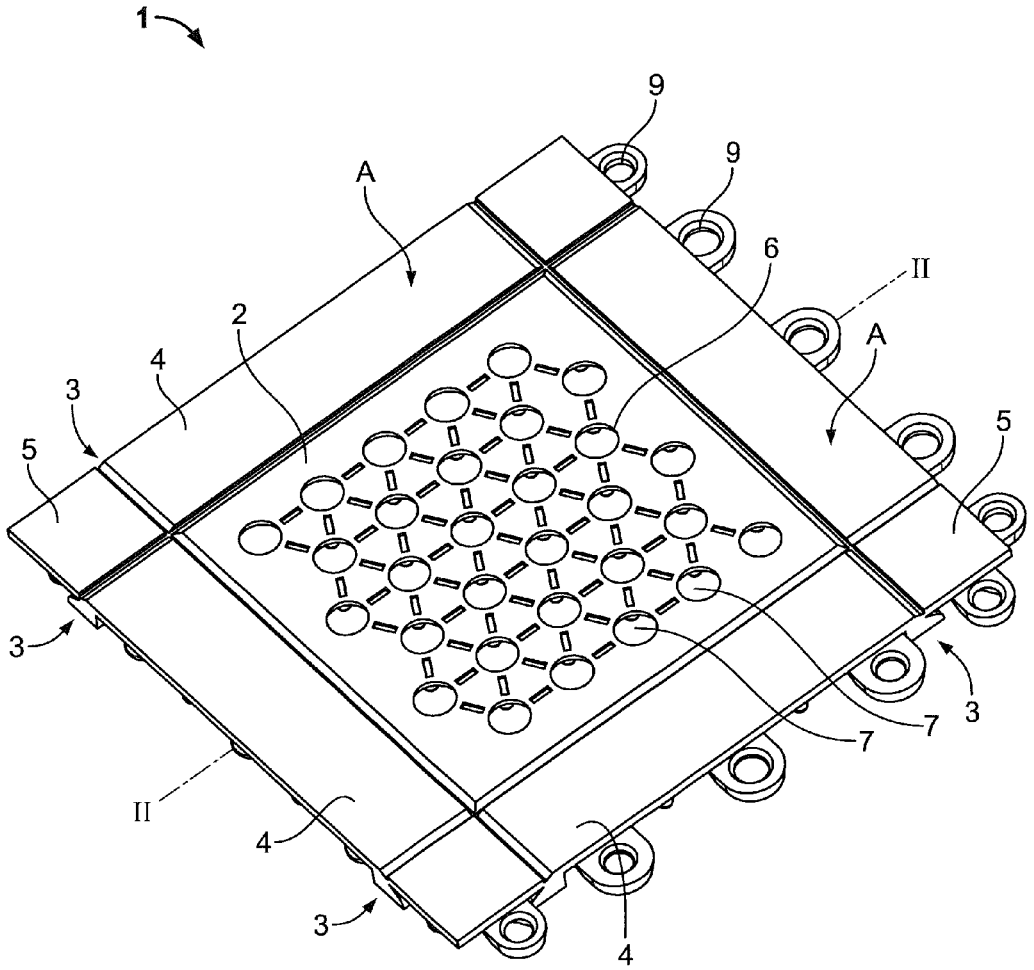
FIG. 1B is a perspective view of FIG. 1A, showing the upper portion of the mat in an embodiment of the invention.

Referring to FIGS. 1A and 1B, the mat 1 comprises an inner core structure 2, and an outer panel structure "A", highlighted in the shaded area, surrounding inner core structure 2.

FIGS. 1A and 1B also illustrate traction surfaces 6 in a pattern of ridges or elevations to increase friction on the surface, in this case, the top surface of an upper portion, of the mat inner core structure 2. However, these ridges and various top surface designs are optional, and are not known to be critical. In embodiments of the present invention, the top surface of the mat, particularly the inner core structure 2, may comprise a friction promoting surface coated thereon, as well as or in place of ridges and/or apertures 7.

The top surface of mat 1, particularly the inner core structure 2, may comprise any number of patterns of holes or apertures 7 to allow the passage of air or a liquid. These mat or tiles are also suitable for wet working environments. Further, as mentioned above, apertures 7 also serve to provide a degree of slip resistance to complement traction surfaces 6. Although apertures 7 are depict apertures of the present invention, it is to be understood that any suitable shaped or sized aperture could also be used, inasmuch it serves to provide the requisite drainage, traction and structural integrity of the mat and assembled mat system.

Figure 1C:
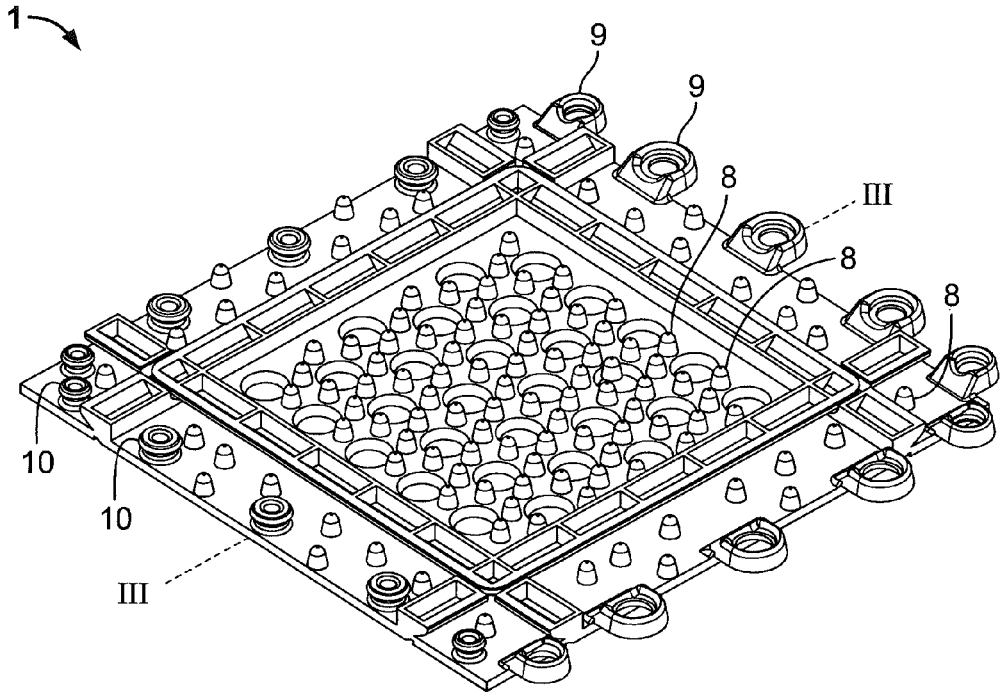
FIG. 1C is a perspective view of an underside or lower portion of the mat structure of FIG. 1A.

FIG. 1C depicts the underside of mat 1. Shown in FIG. 1C are support legs 8, which extend between the upper portion and lower portions of mat 1. Note that in a preferred embodiment, support legs 8 are provided on the underside of the entire mat 1 in both the inner core and outer panel structures. Legs 8 support load on the surface of the mat, distributing loads from the upper to lower portions of the mat 1, and ultimately to the flooring or ground upon which the mat rests.

The support legs 8 are exemplified by knoblike, peg like, conical, truncated conical members. However, any conventional supporting shaped structures can be used in place of those mentioned above.

Also, FIG. 1A shows a series of outwardly projecting female connectors 9, which interconnect with complementary male connectors 10 of FIG. 1C, located on the underside of mat 1. Male connectors 10 and female connectors 9 serve to interlock adjacent mats to form a mat system.

The term "male" refers to knob, pin or peg-type components. The term "female" refers to the components that have a socket or lug-type compartment that is sized and spaced to accommodate the "male" component. The "male" and "female components are complimentary to one another in the sense that the "male" components may be securely inserted into the "female" components in a way that provides a mechanism for holding adjacent tiles to one another. As described herein, "male" components may be used to assist in providing vertical support to the mat, whether coupled to a "female" component of an adjacent tile or not. Typically, all male components provide some type of vertical support to the mat.

Referring to FIGS. 1B and 1C, included in the mat 1 are side panels 4 and corners panels 5, At least one set of outer female connectors 9 are connected to and preferably projecting away from the mat along at least a portion of the peripheral edges of the side panels 4 or corner panels 5 are provided. The female connectors 9 each has a side thickness less than the mat thickness and are substantially flush with the bottom of the mat so as to create a step upon which a corresponding male connector of complementary thickness rests so as to result in an interlocked mat system of substantially equal thickness. When designating adjacent side or corner panels, the prime "'" designator is used to more easily identify the specific panels being identified.

Complimentary male connectors 10 are provided and they project below a top surface of the side panels 4 and corner panels 5. Further, each male connector 10 is along an edge of the mat opposite to the side of the mat having a corresponding female connector. The male connectors 10 are adapted to engage recesses of the female connectors 9 of an adjacent mat and the recesses of each female connector are adapted to receive inner male connectors of an adjacent mat to link one or more adjacent mats together.

An embodiment illustrated in FIG. 1B or 1C depict female connectors located on two adjacent sides of the mat, and male connectors symmetrically located on the remaining adjacent sides (FIG. 1C). However, it is important to recognize that the novelty of the invention does not rely on the manner in which panels are interlocked. For example, while preferred, the female connector locations do not have to be on two adjacent sides of the mat. For example, the female connector locations can alternate with the male connector locations in any desired pattern. Any conventional manner of interlocking techniques can be applied to interlock adjoining mats to the extent they cooperates with the novel ramp exposure design provided by the mat of the present invention.

Figure 2A:
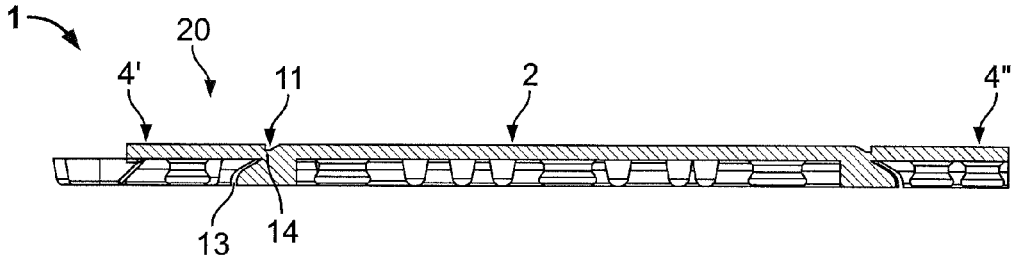
FIG. 2A is a cross-sectional view of along the line I-I of FIG. 1A.

A key feature of the present invention is a ramp structure 20, which comprises a pair of ramped surfaces 11 and 13 and is depicted in FIG. 2A as a cross section of mat 1 along line I-I of FIG. 1A. Ramp surfaces 11 and 13 surround the inner core structure 2 and form a tapered profile from the upper portion of mat 1 to the lower portion of mat 1. This tapered ramp structure 20 is preferably molded into the mat 1 to form a peripheral edge or a number of discrete of sides of the inner core structure 2. The peripheral edge or sides of the inner core structure 2 are connected to the outer panel structure "A" (shaded area "A" in FIG. 1A) by an attachment structure 14, which effectively bridges the ramped surface 11 and 13 of the inner core structure 2, with the side panels 4' and 4", see FIG. 2A.

FIG. 1B, depicts a perspective top view an upper portion of rectangular mat 1, illustrating four side panels 4, and four corner panels 5, comprising the outer panel structure A and surrounding inner core structure 2. The side panels 4 and corner panels 5, in the outer panel structure A are defined by channels 3, which can also be characterized as troughs or grooves and can be molded into the upper and lower portions of the mat forming said attachment structure 14. FIG. 1B illustrates four channels 3 molded into the upper portion of the mat 1 with the mat being rectangular in shape.

Referring to FIGS. 1A and 1B, in a preferred embodiment, the profile of the ramped side structure of inner core structure 2 extends in straight lines along the channels 3 of the inner core structure 2 to delineate the side panes. The channels 3 continue to extend to the periphery of the edge of the mat 1, thereby effectively forming the side panels 4 and corner panels 5. With reference to FIG. 2A, the ramped structure as surfaces 11 and 13 is thereby formed on side panels 4' and side panel 4" adjacent to inner core structure 2.

Figure 2B:
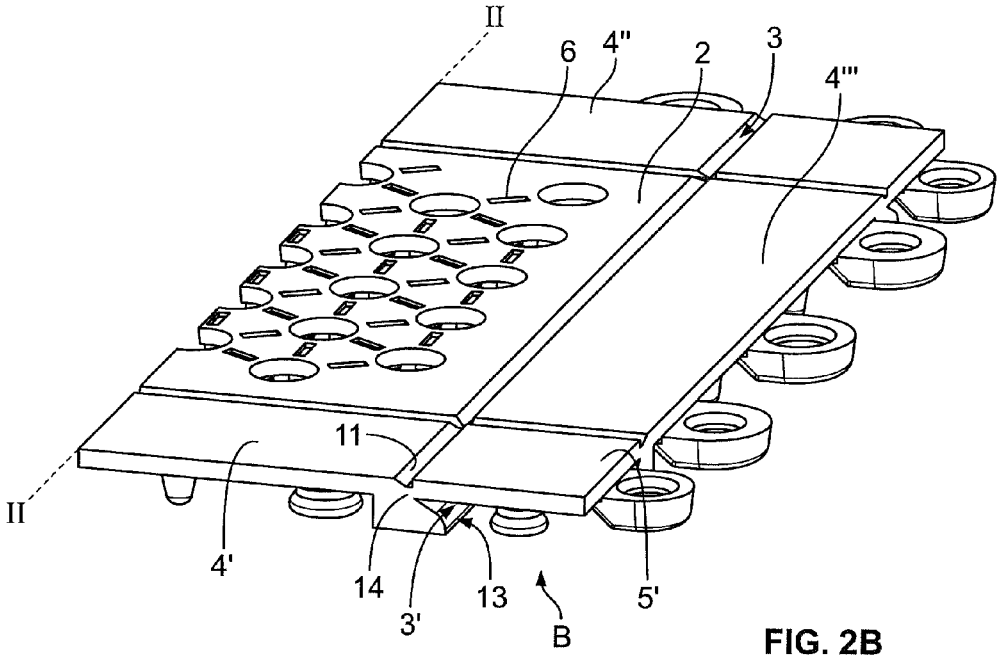
FIG. 2B is an enlarged perspective view of a mid-portion of the mat of FIG. 1B along lines II-II.

Ramped surfaces 11 and 13 are disposed on the sides of the side panels 4' which face corner pieces 5'. With reference to FIG. 2B, an attachment structure 14 bridges and connects the ramped surfaces 11 and 13 of side panels 4' with corner panels 5'.

Figure 2C:
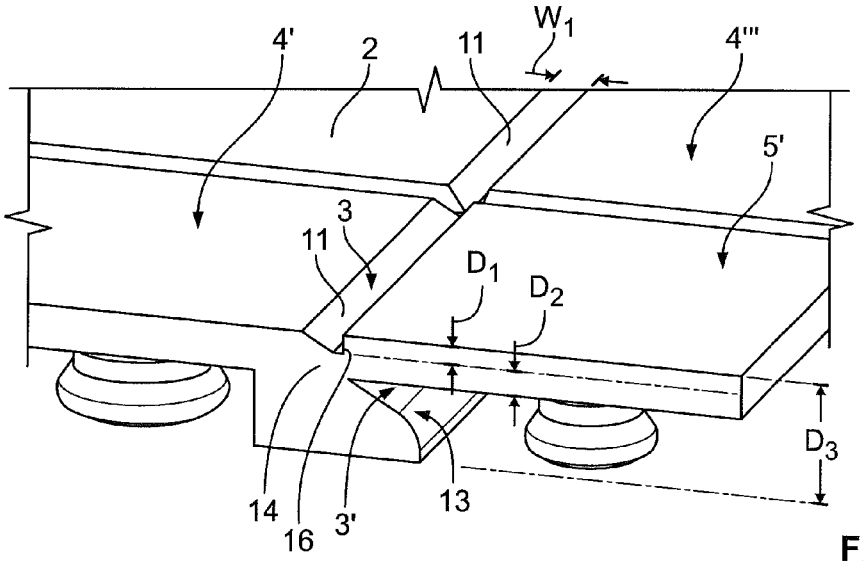
FIG. 2C is an enlarged view of section B of the mat of FIG. 2B.

Referring to FIGS. 2B and 2C, channels 3 and 3' (see FIG. 2C) are molded into the upper and lower portions of the mat, respectively, which form said attachment structure 14. Channel 3, which dips below the top surface of the mat, forms one portion of attachment means 14 bridging a ramped surface 11 of the inner core structure 2 with adjacent side panel 4'".

Figure 3:
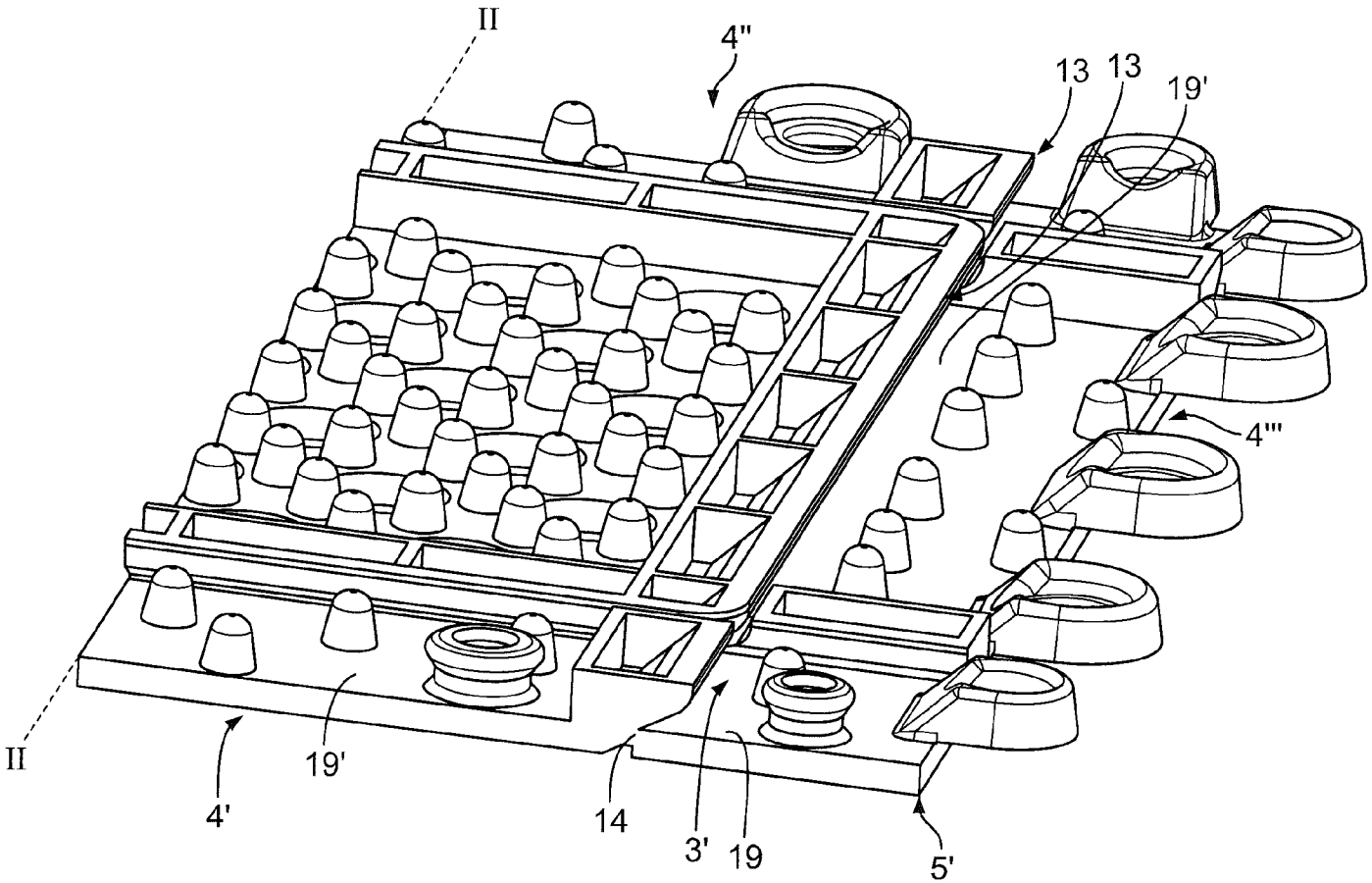
FIG. 3 shows a perspective view of the underside of the mat section of FIG. 2B.

In FIG. 3, an underside of the mat of FIG. 2B illustrates the second channel 3' situated between ramp surface 13 and a bottom surface of either side panel 19' or corner panel 19, for example. Second channel 3' forms another portion of attachment structure 14.

FIG. 2C further illustrates the width $W_1$ of upper channel 3 and depth $D_1$ of upper channel 3 measured from the top of the upper portion of mat 1. Further, depth $D_2$ is a measure of the thickness of the attachment structure 14, connecting side panel 4' to corner panel 5' and also connecting the inner core structure 2 to opposing side panels 4'". Finally, depth $D_3$ is representative of the overall mat thickness. Upper channel $W_1$ minimum widths are chosen to accommodate the dimension of an edge of a knife, blade or other cutting tool used to sever selected panels from the mat 1. Maximum widths are generally dictated by the slope of ramped surfaces 11 and 13 and depths $D_1$ and overall thickness $D_3$ of mat 1. Channel depth $D_1$ is dictated by the selected upper channel width $W_1$ and slope of ramped surfaces 11 and 13. The thickness $D_2$ of the attachment structures 14 is optimized to allow easy and accurate cuts through attachment structure 14 and along ramped surfaces 11 and 13. Smaller thicknesses $D_2$ facilitate cutting and accuracy of cuts along ramped surfaces 11 and 13. Larger $D_2$ thicknesses, in comparison, offer a more rigid attachment between the inner core structure 2 and the side panels 4, and between the side panels 4 and corner panels 5. Larger mat thicknesses $D_3$ require larger attachment structure thicknesses $D_2$ to support the side panels to the inner core structure 2, for example. For the purposes of this invention, the overall mat thickness $D_3$ is from about 0.1 inches to 1.0 inches, more preferably, from 0.1 to 2.0 inches. The attachment structure D2 thickness ranges from 0.1 to 0.2 inches, preferably 0.05 to 0.5 inches. Channel widths $W_1$ preferably range from 0.1 to 1.0 inches.

Of course, one of ordinary skill in the art would be able to determine optimum values of $D_2$ for a particular mat material, given a desired target mat thickness $D_3$ and selected slope along ramped surfaces 11 and 13.

Figure 5A:
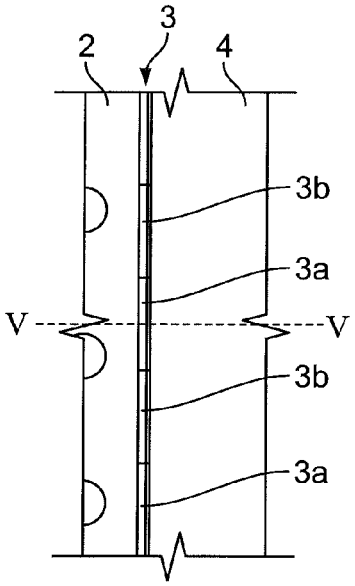
FIG. 5A and FIG. 5B show an alternative embodiment, wherein the attachment structure that links the inner core structure and outer panel structure is not continuous.
Figure 5B:
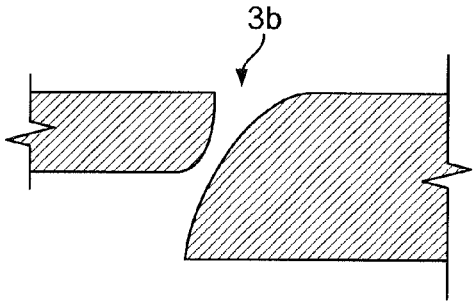

It is also possible that the bridge attachment structure 14 in FIGS. 2B and 2A, respectively, can be discontinuous when viewed from the upper portion of the mat panel. Put another way, the attachment structure 14 would be continuous and an opening would be provided in the channel 3 such that the ramp surface (the ramp surfaces 11 and 13 are interrupted by the attachment structure until the channel is severed to form the complete ramp border for the mat) would be continuous from the top to the bottom of the mat. FIGS. 5A and 5B illustrate this embodiment. FIG. 5A shows a section of a channel 3 between a side portion of the inner core structure 2 and a side panel 4. Opening 3*b* are formed to create spaced apart tab segments 3*a*, which form the attachment structure to link the inner core structure 2 to the side panel 4. The spacing of the tab segments 3*a* can vary with the proviso that there should not be too many openings 3*b* so as to comprise the integrity of the attachment structure linking the inner core structure 2 to the side panels 4. The openings could also be used between the side panels and corner panels if so desired.

A typical tile of the present invention may be manufactured by injection or compression molding, and typically comprise a thermoplastic material such as flexible thermoplastic polyurethanes (TPU), or semi-rigid polyvinyl chloride or thermoplastic elastomer. Additionally a thermosetting plastic such as rubber may be used. Basically any material that is semi-rigid, semi-flexible, or elastomeric (e.g., flexible PVC, thermoplastic elastomers) that are capable of being injection molded can be used. Additionally, thermosetting rubbers and thermosetting elastomers capable of being compression molded can be used. Alternatively, the side and corner panels could be linked to the inner core structure using an adhesive technique, which would still maintain the integrity of the attachment structure and its link between the inner core structure and the side and corner panels and provide an alternative method of making the mat to molding.

The plastic or rubber material should exhibit some degree of conformability so as to provide comfortable footing and mating of the tiles. Additionally, the material should exhibit a reasonable degree of structural integrity so as to support personnel and light industrial traffic. One of ordinary skill in the art can chose a material based on many desired characteristics of the resulting tile. For example, a material may be that is resistant to oils, greases, weak solvents, and chemicals typical of an industrial environment. A material may be chosen to exhibit a reasonably high coefficient of friction so as to reduce the risk of slipping. Additionally, embodiments of the present invention may also be conditioned to withstand inclement weather or other harsh environments, heavy traffic, and to resist damage when exposed to harsh chemicals.

In this invention, a further requirement is that the selected mat or tile material be soft enough to be easily severed or cut by a knife or blade or other cutting implement to facilitate removal of the mat elements to expose desired ramp borders in the final mat system or assembly. This requirement therefore defines which of the material or formulations of the materials can be preferably used.

Since the attachment structure 14 is integral and therefore preferably formulated with the same materials as both the internal core and outer panel structures, it is important that the materials used to form the mat panels, preferably by molding operations, be soft enough to allow cutting operations, preferably with a hand operated cutting tool. Mat compositions which provide cushioning with few exceptions are amenable to being cut with a knife or blade. It is preferred to use thermoplastic for the mat composition, satisfying structural requirements above and are easily cut using a knife or blade. However, any conventional thermoplastic or thermosetting polymer material meeting the mat requirements earlier above with the proviso that the Shore Hardness of the formed mat is in the range of from 50 to 95 A to facilitate cutting of the mats to expose a ramped border around the periphery of the assembled mat system.

Figure 6:
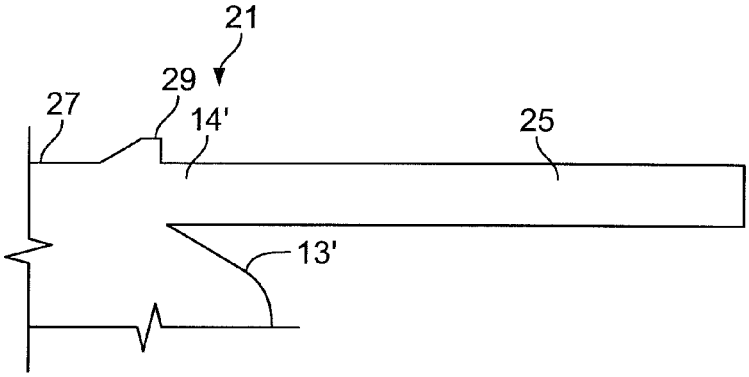
FIG. 6 shows an alternative attachment structure for the mat.

While FIG. 2A shows the attachment structure between the ramp surfaces 11 and 13, the attachment structure could be formed so that it is flush with a top surface of the mat so that there would be only one ramp surface 13 instead of two ramps surfaces 11 and 13, see FIG. 6, wherein the attachment structure 14' would be severed along line 23 to separate the panel 25 from the inner core structure 27. This embodiment does not provide the channel 3 on the top surface of the mat embodiment shown in FIG. 1*b* for cutting through the attachment structure and would require the mat to be ideally cut from the bottom. Alternatively, the mat surface could be molded with some indicator, e.g., a raised protrusion or slight indent so that the cut could be made through attachment structure 14' from the top. An example of such a protrusion is shown as 29 in FIG. 6.

In yet another embodiment, the mat would be made so that the underside of the corner panel or side panel could extend so that it is aligned with the underside of the inner core structure. In this embodiment, the channel would extend upwardly with the one ramp surface still existing and be more like a slit than the v-shape depicted in the drawings when the underside of the side panel or corner panel does not extend so as to align with the bottom of the mat. With the underside of the corner panels and side panels extending to the bottom of the overall mat, the channel could be formed from the top surface and the attachment structure would be at the bottom of the mat rather than at the top as shown in FIG. 6.

Another aspect of the invention is a method of constructing the novel mat of the present invention into a mat assembly or mat system having a ramped border.

First, the mats of the present invention are interconnected on adjacent sides to form a desired pattern. Either during or after assembly, internal core, side or corner panels to be simply cut out of the mat along any of the channels to expose the desired ramp surface around the periphery or border of the mat system.

Referring to FIG. 1B, cutting along channels 3, situated in the upper mat portion, for example, severs the attachment structure 14 which bridges the inner core structure 2 with side panels 4 and/or attachment structure 14 bridging the side panels 4 and corner panels 5. Cutting away the side or corner panels from the mat 1, preferably along edge 16 of cutting channel 3 (See FIG. 2C), thereby exposes the ramped surfaces 11 and 13 of the inner core structure 2 and sides panels 4, thereby creating a ramped border around the edge of a mat system. Alternatively, the mat side and corner panels can be cut from the underside of the mat, if so desired.

Figure 4A:
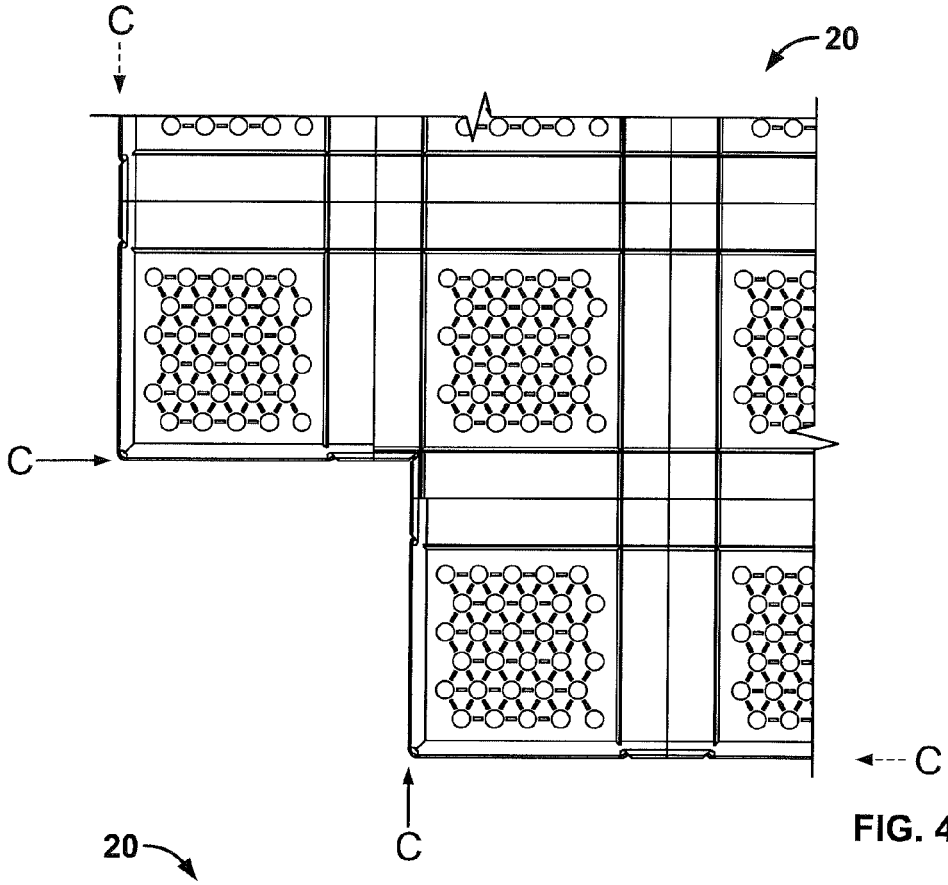
FIG. 4A illustrates a top view of a section of a system of interconnecting mats after selected portions of outer panel members have been removed to expose selected internal ramp structures bordering the mat system.

FIG. 4A shows an example of a cutting, wherein only a portion of the entire mat system is illustrated. This Figure illustrates the connection of 8 mats with corner panels and side panels removed to expose a ramped border along lines "C".

Figure 4B:
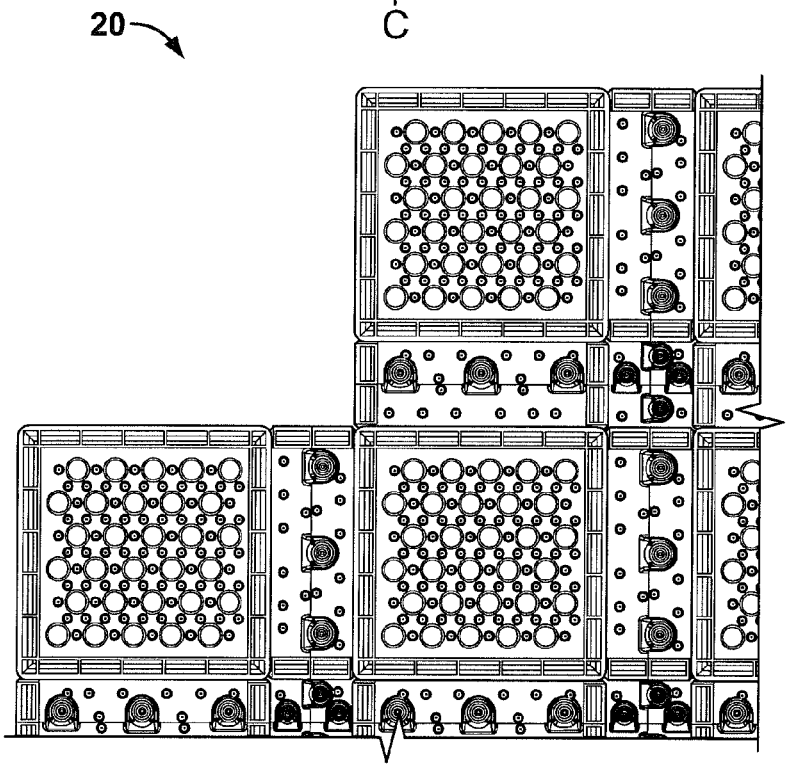
FIG. 4B illustrates an underside view of FIG. 4A.

FIG. 4B shows an underside of a portion of the completed mat system of FIG. 4A and which also illustrates the interconnection of adjacent mats according to the present invention.

As such, an invention has been disclosed in terms of preferred embodiments thereof which fulfills each and every one of the objects of the present invention as set forth above and provides a new and improved interlocking modular mat with an integral ramp feature and method of use.

Of course, various changes, modifications and alterations from the teachings of the present invention may be contemplated by those skilled in the art without departing from the intended spirit and scope thereof. It is intended that the present invention only be limited by the terms of the appended claim.

I claim:

1. An interlocking modular mat comprising, an inner core structure and outer panel structure, the outer panel structure attached to an entire periphery of said inner core structure; wherein, said inner core structure is generally planar, comprising upper and lower surfaces and a peripheral edge, the peripheral edge including at least one side surface portion, said at least one side surface portion of said inner core structure being tapered to form a ramp; wherein, said outer panel structure is spaced apart from said inner core structure by an attachment structure which is integral to both said inner core structure and said outer panel structure, at least one channel forming at least a portion of said attachment structure in said mat and adjacent to the peripheral edge of said inner core structure, the at least one channel acting as a guide for separation of the inner core structure from one or more portions of the outer panel structure by cutting of the attachment structure, and interlocking members are affixed to said outer panel structure of the interlocking modular mat to attach the outer panels of adjacent interlocking modular mats together.

2. The interlocking modular mat of claim 1, further comprising another channel on an opposite side of the interlocking modular mat opposing the at least one channel.

3. The interlocking modular mat of claim 2, wherein said channels extend in straight lines along the edges of said inner core structure and into said outer panel structure, thereby partitioning said outer panel structure into side panels and corner panels.

4. The interlocking modular mat of claim 1, wherein interlocking members are located on sides of said outer panel structure which mate with interlocking members on adjacent interlocking modular mats.

5. The interlocking modular mat of claim 4 wherein interlocking members comprise peg and hole structures.

6. The interlocking modular mat of claim 1 wherein interlocking members comprise peg and hole structures.

7. The interlocking modular mat of claim 1, wherein said attachment structure is made from a mat material capable of being detached from said inner core structure by cutting said mat material.

8. The interlocking modular mat of claim 7, wherein the interlocking modular mat is formed from a thermoplastic or thermosetting material which has a shore hardness from 50 to 95 A.

9. The interlocking modular mat of claim 1 wherein said attachment structure is in the form spaced apart tab segments along said at least one channel.

10. A plurality of assembled interlocking modular mats or tiles of claim 1.

11. An interlocking modular mat comprising, an inner core structure and outer panel structure attached to the periphery of said inner core structure; wherein, said inner core structure is generally planar, comprising upper and lower surfaces and a peripheral edge, the peripheral edge including at least one side surface portion, said at least one side surface portion of said inner core structure being tapered to form a ramp; wherein, said outer panel structure is spaced apart from said inner core structure by an attachment structure which is integral to both said inner core structure and said outer panel structure, at least one channel forming at least a portion of said attachment structure in said mat and adjacent to the peripheral edge of said inner core structure, the at least one channel acting as a guide for separation of the inner core structure from one or more portions of the outer panel structure by cutting of the attachment structure, and interlocking members are affixed to said outer panel structure of the interlocking modular mat to attach the outer panels of adjacent interlocking modular mats together, further comprising another channel on an opposite side of the interlocking modular mat opposing the at least one channel, wherein said channels extend in straight lines along the edges of said inner core structure and into said outer panel structure, thereby partitioning said outer panel structure into side panels and corner panels, and wherein said interlocking modular mat is rectangular in shape and said outer panel structure comprises four side panels attached to said inner core structure and four corner panels attached to said side panels.

12. The interlocking modular mat of claim 11, wherein interlocking members are located on sides of said outer panel structure which mate with interlocking members on adjacent interlocking modular mats.

13. The interlocking modular mat of claim 11, wherein interlocking members comprise peg and hole structures.

14. The interlocking modular mat of claim 11, wherein said attachment structure is made from a mat material capable of being detached from said inner core structure by cutting said mat material.

15. The interlocking modular mat of claim 11, wherein the interlocking modular mat is formed from a thermoplastic or thermosetting material which has a shore hardness from 50 to 95 A.

16. The interlocking modular mat of claim 11, wherein said attachment structure is in the form spaced apart tab segments along said at least one channel.

17. A plurality of assembled interlocking modular mats or tiles of claim 11.

18. An interlocking modular mat comprising, an inner core structure and outer panel structure attached to the periphery of said inner core structure; wherein, said inner core structure is generally planar, comprising upper and lower surfaces and a peripheral edge, the peripheral edge including at least one side surface portion, said at least one side surface portion of said inner core structure being tapered to form a ramp; wherein, said outer panel structure is spaced apart from said inner core structure by an attachment structure which is integral to both said inner core structure and said outer panel structure, at least one channel forming at least a portion of said attachment structure in said mat and adjacent to the peripheral edge of said inner core structure, the at least one channel acting as a guide for separation of the inner core structure from one or more portions of the outer panel structure by cutting of the attachment structure, and interlocking members are affixed to said outer panel structure of the interlocking modular mat to attach the outer panels of adjacent interlocking modular mats together, further comprising another channel on an opposite side of the interlocking modular mat opposing the at least one channel, wherein said channels extend in straight lines along the edges of said inner core structure and into said outer panel structure, thereby partitioning said outer panel structure into side panels and corner panels, wherein said ramp extends on sides of each side panel, each ramp of each side panel adjacent to a side of a said corner panel.

19. A plurality of assembled interlocking modular mats or tiles of claim 18.

* * * * *